United States Patent [19]

Koizumi et al.

[11] 4,141,795

[45] Feb. 27, 1979

[54] DRY TYPE METHOD FOR QUENCHING COKE

[75] Inventors: Kunihei Koizumi; Takeshi Ueda, both of Yokohama; Tatu Otani, Yokosuka; Toshinobu Katata, Yokohama, all of Japan

[73] Assignee: Nippon Kokan Kabushiki Kaisha, Tokyo, Japan

[21] Appl. No.: 811,128

[22] Filed: Jun. 28, 1977

[30] Foreign Application Priority Data

Jul. 6, 1976 [JP] Japan ..... 51-79456
Jun. 24, 1977 [JP] Japan ..... 52-74525

[51] Int. Cl.[2] ..... C10B 39/02

[52] U.S. Cl. ..... 201/39; 202/228; 201/1; 432/37; 266/156

[58] Field of Search ..... 201/1, 39, 43; 23/253 A; 432/14, 15, 37, 41, 58; 202/227, 228; 110/185, 186, 189; 266/80, 156

[56] References Cited

U.S. PATENT DOCUMENTS

| | | | |
|---|---|---|---|
| 2,625,386 | 1/1953 | Leone | 432/37 X |
| 3,774,315 | 11/1973 | Schmalfeld et al. | 201/39 X |
| 3,895,448 | 7/1975 | Jonnet | 202/228 X |
| 4,038,032 | 7/1977 | Brewer et al. | 23/253 A |
| 4,040,789 | 9/1977 | Voss et al. | 266/80 X |
| 4,062,529 | 12/1977 | Altenhoner et al. | 266/156 |
| 4,076,593 | 2/1978 | Koizumi et al. | 201/39 |

*Primary Examiner*—Morris O. Wolk
*Assistant Examiner*—Roger F. Phillips
*Attorney, Agent, or Firm*—Flynn & Frishauf

[57] ABSTRACT

In a dry type method and apparatus for quenching coke wherein hot coke charged in a coke quenching installation is cooled by circulating cooling gas in the installation through a closed circulating system including a blower and a heat exchanger, the composition of the cooling gas is analyzed and compared with a reference gas composition and air or nitrogen gas is supplemented to the closed circulating system in accordance with the result of comparison. A portion of the circulating gas is discharged to the atmosphere when air or nitrogen gas is supplemented. Air is supplemented on the high temperature discharge side of the circulating cooling gas while nitrogen gas is supplemented on the low temperature inlet side. The cooling gas is discharged to the atmosphere before the supplementation of the nitrogen gas.

6 Claims, 2 Drawing Figures

DRY TYPE METHOD FOR QUENCHING COKE

BACKGROUND OF THE INVENTION

This invention relates to a method and apparatus for quenching hot coke discharged from a coke oven buttery.

Instead of quenching hot coke by wet type method of quenching, it is a recent trend to cool the hot coke with cold inert gas. According to such dry type method of quenching it is possible to efficiently cool the hot coke without producing a large amount of smoke and steam thus preventing the problem of public hazard. Moreover, as it is possible to recover the heat of the gas utilized for the cooling, thereby increasing thermal efficiency. However, when the cooling gas is repeatedly used its composition changes so that it is necessary to add a predetermined amount of nitrogen gas or air at a definite interval for adjusting the composition of the cooling gas. However, with this method it is not always possible to correctly readjust the composition. Moreover, such method not only requires to use a large amount of nitrogen gas and but also the yield of coke is low. In certain cases, there is a danger of explosion and the operator is requested to constantly watch the operating condition and manipulate a number of valves.

SUMMARY OF THE INVENTION

It is an object of this invention to provide an improved dry type method and apparatus capable of reducing the amount of nitrogen gas to be supplemented to the circulating cooling gas, can reduce the danger of explosion and can produce cooled coke at high yields.

According to one aspect of this invention, there is provided a dry type method of quenching coke of the type wherein hot coke discharged from a coke oven buttery is charged in a coke quenching installation, and cooling gas comprising a mixture of $CO_2$, $O_2$, CO, $H_2$ and $N_2$ is circulated through the coke quenching installation through a closed circulating system for cooling the hot coke, characterized by the steps of analyzing the composition of the circulating cooling gas, supplementing air to the circulating cooling gas on the high temperature discharge side when the CO component increases and supplementing nitrogen gas when the $H_2$ component increases, and discharging a quantity of the circulating cooling gas from the closed circulating system depending upon the quantity of the air and nitrogen gas supplemented.

According to another aspect of this invention, there is provided dry type apparatus for quenching coke of the type comprising a vertical coke quenching installation provided with a charging hole at the top for charging hot coke discharged from a coke oven battery, a discharge hole for discharging cooled coke, and gas inlet and discharge ports for circulating cooling gas of a predetermined composition through the coke quenching installation, a closed circulating system connected between the gas inlet and discharge ports and including means for cooling the cooling gas and a blower for circulating the cooling gas through the coke quenching installation, wherein there are provided a gas component analyzer, a comparator for comparing the output of the analyzer with a reference gas composition, means including a valve for supplementing air to the closed circulating system near the gas discharge port, means including a valve for supplementing nitrogen to the closed circulating system near the gas inlet port, means including a valve for discharging a quantity of the cooling gas from the closed circulating system, and means responsive to the output of the comparator for controlling the valves.

For example the cooling gas has a composition consisting of 4.6% of $CO_2$, 0.5% of $O_2$, 13.5% of CO, 3.4% of $H_2$ and 78% of $N_2$ by volume.

According to this invention, depending upon the variation in the combustible components of the circulating cooling gas, air and nitrogen gas are supplemented automatically and surplus cooling gas is discharged to atmosphere for ensuring efficient cooling of coke with cooling gas having a composition close to that of a reference gas composition, thereby increasing the yield, and decreasing the danger of explosion and the quantity of nitrogen gas supplemented.

The analysis of the gas composition is made on the low temperature inlet side for enabling easy measurement. Where a waste gas boiler is used as the heat exchanger in the closed circulating system, by locating the analyzer at said position it is possible to detect the leakage of the water of the boiler into the closed circulation system and also prevent the air introduction into the negative pressure portion at the low temperature side thereof. Admission of air on the high temperature side prevents the decrease in the yield and makes stable oxidizing reaction of the combustible components. The nitrogen gas supplemented on the low temperature side is used at once for cooling the coke. Moreover as the nitrogen gas is supplemented on the downstream side with respect to the surplus gas discharging pipe, it is possible to prevent escape of the supplemented nitrogen gas through such surplus gas discharging pipe. In this case, excess gas is discharged from the top of the furnace in proportion to the amount of $N_2$ supplemented. Furthermore, as the high temperature exhaust gas enriched with air, that is oxygen is not directly used for cooling the coke, it is possible to decrease the danger of explosion and the yield of the cooled coke.

BRIEF DESCRIPTION OF THE DRAWING

In the accompanying drawing.

DESCRIPTION OF THE PREFERRED EMBODIMENT

Figure 1:
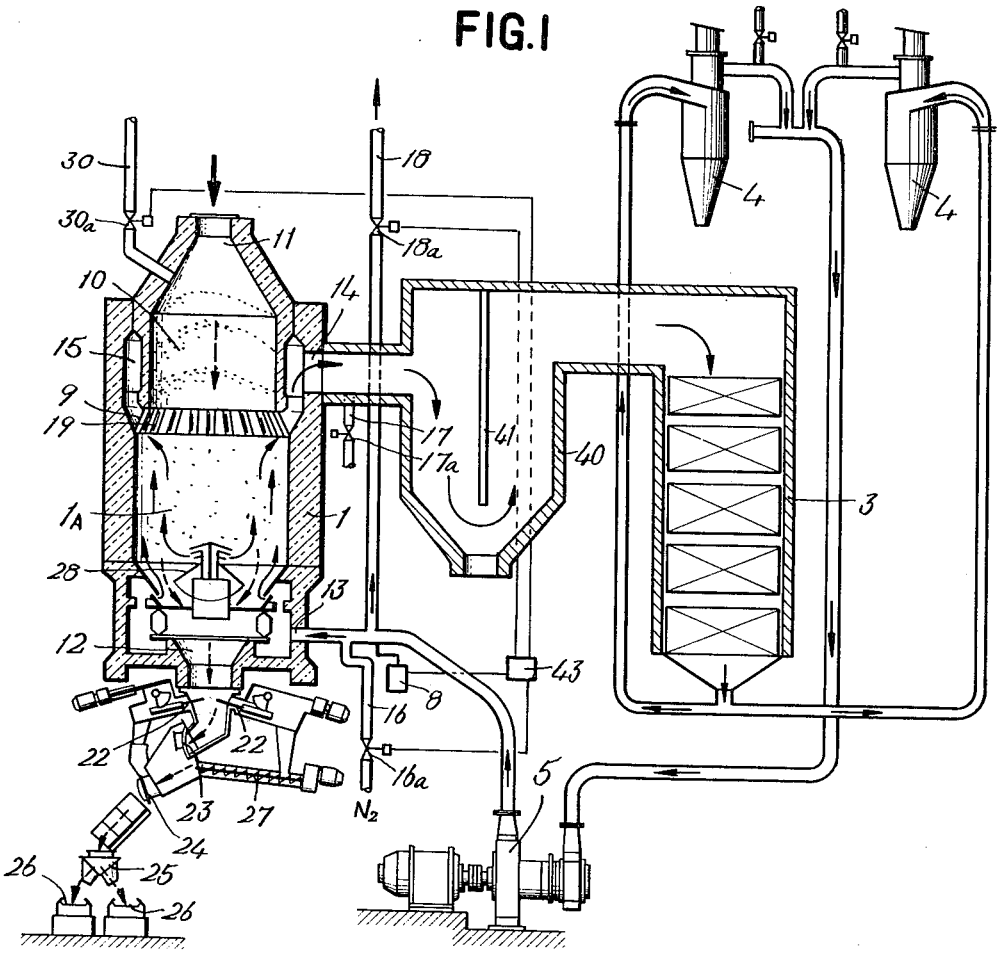
FIG. 1 is a diagrammatic representation, partly in section, of the apparatus utilized to carry out the method of this invention.

A preferred embodiment shown in the accompanying drawings comprises a vertical coke quenching installation, provided with a pre-chamber 10 at its upper end for receiving hot coke discharged from a coke oven battery, not shown through a charging hole 11. Although not shown, the charging hole 11 is provided with a lid or a sliding damper so as to open the charging port at the time of charging the coke. Between the pre-chamber 10 and the coke quenching chamber 1A is provided a downwardly inclined inner surface 9 having a groove shaped gas guide 19 for sequentially guiding said gas therethrough into an annular space 15, when coke has been packed in the installation. A discharge hole 12 is formed at the bottom of the coke quenching installation 1 for discharging cooled coke and a pair of opposed mechanisms 22 for adjusting the quantity of discharged coke are provided at the discharge hole 12.

First and second lids 22 and 23 are also provided for the bottom of the coke quenching installation. The cooled coke discharged through lid 24 is supplied to a conveyor 26 via a distributor 25. A cooling gas inlet port 13 opens at one side of the coke quenching installation 1. Said annular space 15 provided with a gas discharge opening 14 is provided around the pre-chamber 10. The hot coke descending into the installation 1 from the pre-chamber 10 is cooled by cooling gas blown into the installation 1 through the inlet port 13 and rising toward the discharge port 14. The coke charged into the pre-chamber 10 at a temperature of from 1000 to 1050° C is cooled down to about 200° C and then discharged through the discharge hole 12. At the bottom of the coke quenching installation 1 is provided a screw conveyor 27 for feeding the coke not permitted to flow through the adjusting mechanisms 22 to the first lid 23. A distributor 28 is provided in the installation 1 near the bottom thereof for causing the coke to descend along the inner periphery of the installation 1 and for dispersing the rising cooling gas. A blower 5 is provided for the inlet port 13. The cooling gas discharged through the discharge opening 14 is conveyed to a heat exchanger 3, a waste gas boiler for example, via a dust collector 40 including a vertical partition wall 41. The gas discharged from the heat exchanger 3 is sent to the blower 5 via dust separator 4, thus forming a closed gas circulating system for cooling the hot coke. The temperature of the circulating gas is about 180° C at the inlet port 13, and about 800° C at the discharge port 14. A rotary filter, not shown, is provided at the bottom of the dust collector 40 for discharging the collected dust.

During the operation of the apparatus described above, the composition of the cooling gas containing nitrogen as the major proportion varies gradually due to the gas generated from red coke in said pre-chamber 10 thereby increasing harmful gas components such as $O_2$, CO and $H_2$. For this reason, not only the yield of the cooled coke is reduced but also a danger of explosion and fire hazard occurs. According to this invention, for the purpose of preventing the variation in the component of the cooling gas a $N_2$ gas supplementing pipe 16 including a valve **16*a* is connected between the blower 5 and the cooling gas inlet port 13. Further, an air supplementing pipe 17 including a valve 17*a* is connected near the discharge port 14. Vent pipes 18 and 30 respectively including valves 18*a* and 30*a* are connected to the coke quenching installation 1, for example to the cooling gas inlet pipe near the inlet port 13 and near the upper end of the pre-chamber 10. A gas composition detector or analyzer 8 is connected between the vent pipe 18 and the $N_2$ gas supplementing pipe 16. The output of the detector 8 is compared with a reference gas composition by a comparator 40 for operating electromagnetic valves 16*a*, 17*a*, 18*a* and 30*a*** in accordance with the result of comparison as diagrammatically shown in the drawing.

More particularly, there are three types of increase in the combustible gas components, that is $H_2$, CO and $O_2$. According to this invention air and or $N_2$ are automatically supplemented by the mechanism described above. The composition of the cooling gas is analyzed periodically or continuously by the gas composition detector 8, for example a gas chromatograph. Where increase in CO composition is detected by comparing the output of the detector 8 with the reference composition, air is supplemented through the air supplementing pipe 17 located near the discharge port 14 to dilute the gas by a reaction: $2CO + O_2 = 2CO_2$, and the resulting excessive gas is discharged through vent pipe 18.

The excess cooling gas is vented to the atmosphere by opening valve **18*a* in the vent pipe 18. Where increase in $H_2$ or $O_2$ is detected, nitrogen gas is supplemented through the nitrogen supplementing pipe 16 located near the inlet port 13 and the resulting excessive cooling gas is discharged through a gas discharge pipe 30. A gas pressure measuring device is provided for the top of the pre-chamber 10 for discharging the gas generated therein through vent pipe 30**.

Figure 2:
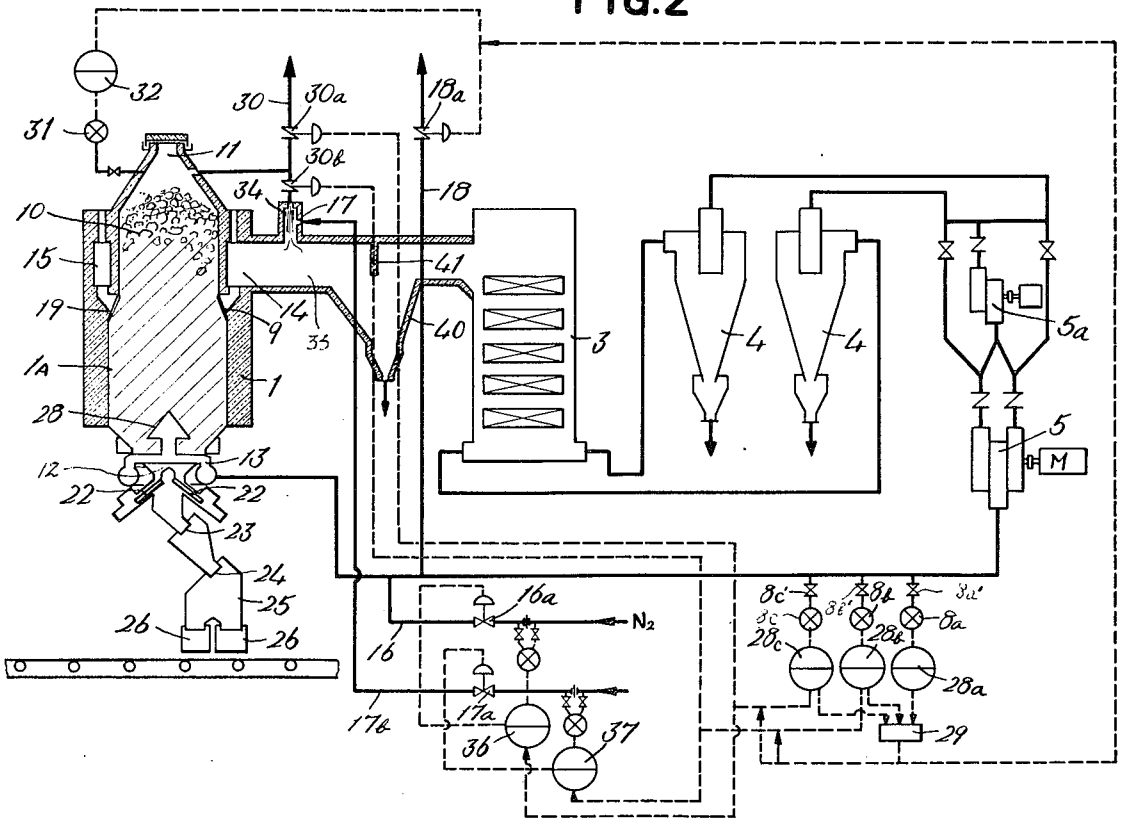
FIG. 2 shows the detail of the embodiment shown in FIG. 1.

FIG. 2 shows the detail of the embodiment shown in FIG. 1, in which corresponding elements are designated by the same reference characters. In FIG. 2, the gas analyzer 8 connected to the gas circulating conduit between the blower 5 and the coke quenching installation 1 comprises three detection elements **8*a*, 8*b* and 8*c* for detecting the concentrations of $O_2$, CO and $H_2$ components respectively. Concentration indicating and adjusting meters 28*a*, 28*b* and 28*c* each provided with a device for alarming a high concentration condition, not shown, are associated with respective detecting elements 8*a*, 8*b* and 8*c* and the outputs of the concentration indicating and adjusting meters 28*a*, 28*b* and 28*c* are connected to a sequence controller 29. In addition to gas discharge pipe 30 shown in FIG. 1, a gas pressure detector 31 is provided for the top of the pre-chamber 10 of the coke quenching installation 1 and the gas pressure detected by the gas pressure detector 31 is recorded by a recorder 32 which also transmits a gas pressure signal to valve 18*a* included in the gas discharge pipe 30 for opening the valve 18*a*. This valve is closed by a signal sent from the sequence controller 29. The gas discharge pipe 30 is connected to a conduit 33 extending between the coke quenching installation 1 and the dust separator 40 through a valve 30*b* and a pit 34 to which air is supplemented through an opening 17 and a pipe 17*b* including the valve 17*a*. $N_2$ gas is supplemented through pipe 16 including valve 16*a*. Flow quantity indicating and adjusting meters 36 and 37 are connected to pipes 16 and 17*b* respectively and these meters 36 and 37 adjust the quantities of the supplemented nitrogen gas and air under the control of the signals from the concentration indicating and adjusting meters 28*c* and 28*b*. A stand by blower 5*a* is provided for circulating the cooling gas when the main blower 5** becomes out of order.

In operation, the concentration indicating and adjusting meters **28*b* and 28*c* compares the outputs of the detecting elements 28*b* and 28*c* with optimum concentration reference values of the composition of the cooling gas which are suitable for the operation of the coke quenching installation 1 for controlling the valves 30*a*, 30*b*, 16*a* and 17*a*. An upper oxygen concentration limit for normal operation is set in the concentration indicating and adjustment meters 28*b* and 28*c* and the oxygen concentration indicating and adjusting meter 28*a* so as to operate an alarming device and to discharge or supplement air as above described when the detected quantity of the oxygen exceeds the reference value, alarm is generated and the following controlls are performed. More particularly, when the concentration of $H_2$ in the circulating cooling gas is higher than the reference value, the concentration indicating and adjusting meter 28*c* opens valve 30*a* for discharging the gas contained in the upper portion of the furnace to the atmosphere and operates the flow quantity indicating and adjusting meter 36 thereby opening valve 16*a* for supplementing nitrogen gas. Conversely, when the concentration of $H_2$ gas is lower than the reference value opposite control is performed to reduce or terminate the discharge of furnace gas and the supply of the nitrogen gas. Similarly the concentration of CO gas is controlled by opening valve 30b by the concentration indicating and indicating meter 28b. Then, the gas in the upper portion of the installation 1 is supplied to a heat exchanger 3, a waste gas boiler for example. At the same time the flow quantity indicating and adjusting meter 37 is controlled so as to start or increase the supply of the air by opening valve 17a**. In this manner the capability of converting CO gas into $CO_2$ gas is increased. Conversely when the concentration of CO gas is lower than the reference value, opposite control is effected.

Where the concentrations of respective gas compositions increase abnormally, respective concentration indicating and adjusting members 28a, 28b and 28c produce alarms and the sequence controller 29 provides an abnormal control. Thus, under such condition, valve 30a is fully opened and then valves 30b and 18a are fully closed. At the same time, a maximum flow quantity command signal is applied to the concentration indicating and adjusting meter 36 to fully open valve 16a whereas a close command signal is sent to the concentration indicating and adjusting member 37, thereby fully closing valve 17a. As these operations are made in a short time, a maximum quantity of $N_2$ gas can be supplemented and the surplus gas can be discharged from the top of the installation 1. At the same time, operator can control the operation for the maximum safeness in response to the alarm.

As above described, air and nitrogen gas are automatically supplemented in accordance with the variation in the composition of the circulating cooling gas thus maintaining an optimum gas composition. As a consequence, it is possible to prevent decrease in the yield of the cooled coke and prevent dangerous conditions. Increase in $H_2$ or $CO_2$ is prevented by air so that it is possible to reduce the amount of expensive nitrogen gas.

In one example, wherein the pre-chamber 10 has an inner volume of 200 $m^3$ and the coke quenching chamber 1A has an inner volume of 250 $m^3$, hot coke was charged at a rate of 50 tons per hour and cooled to 200° C or lower. Cooling gas having a standard composition of 4.6% of $CO_2$, 0.5% of $O_2$, 1.35% of CO, 3.4% of $H_2$, and 78% of $N_2$, by volume was circulated at a rate of 1500 $Nm^3$/hr. The composition of the cooling gas was analyzed continuously, according to the result of which, air or $N_2$ was supplemented to dilute the composition. With this operating condition the reduction of coke by oxidation was extremely small and the yield of the cooled coke was increased by 0.3%. Moreover, the amount of nitrogen gas supplemented was only 150 $Nm^3$/hr and it was possible to continue safely the cooling operation for five hours.

The result of analysis of the gas composition showed that the cooling gas has a composition of 1.5 to 3.2% of $CO_2$, 0% of $O_2$, 1.6 to 14.8% of CO, 0.4 to 5.9% of $H_2$ and 76.6 to 96.5% of $N_2$ showing that this composition ensures safe operation in view of the fact that there is a danger of explosion when the content of oxygen becomes higher than 5%, that of CO becomes higher than 20% and that of $H_2$ becomes higher than 6%.

In contrast, according to the prior art method, under the same operating condition it is necessary to manipulate various valves by manual operation and the yield of the cooled coke was 99.5% due to oxidation of a substantial amount of the coke. Moreover, it was necessary to supplement more than 500 $Nm^3$/hr of nitrogen gas and small explosions were sometimes generated in the installation during coke feeding into the installation.

As above described according to this invention, air and nitrogen gas are automatically supplemented to the circulating cooling gas in response to the variation in the composition of the cooling gas thereby providing an efficient dry type cooling method of coke which is safe and economic and can obtain cooled coke at high yield.

While the invention has been shown and described in terms of a preferred embodiment it will be clearly understood that many changes and modifications will be obvious to one skilled in the art.

What is claimed is:

1. In a dry type method of quenching coke of the type wherein hot coke discharged from a coke oven battery is charged in a coke quenching installation, and cooling gas comprising a mixture of $CO_2$, $O_2$, CO, $H_2$ and $N_2$ is circulated through the coke quenching installation through a closed circulating system for cooling the hot coke, the improvement which comprises the steps of analyzing the composition of said circulating cooling gas, supplementing air to the circulating cooling gas on the high temperature discharge side when the CO component thereof increases and supplementing nitrogen gas on the low temperature side to the circulating cooling gas when the $H_2$ component thereof increases, and discharging a quantity of the circulating cooling gas from said closed circulating system depending upon the quantity of the air and nitrogen gas supplemented whereby the composition of said circulating cooling gas is maintained substantially constant.

2. The method according to claim 1 wherein said cooling gas has a composition consisting of 4.6% of $CO_2$, 0.5% of $O_2$, 13.5% of CO, 3.4% of $H_2$ and 78% of $N_2$ by volume.

3. The method according to claim 1 wherein the temperature of the cooling gas discharged from the coke quenching installation is cooled by a heat exchanger.

4. The method according to claim 1 wherein said cooling gas is discharged from the closed circulating system at the low temperature inlet side of said coke quenching installation according to the quantity of air supplemented and the high temperature outlet side of said coke quenching installation according to the quantity of nitrogen gas supplented.

5. The method according to claim 1 wherein nitrogen gas is supplemented to the circulating gas at a point between an inlet port of the coke quenching installation and the point at the low temperature inlet side at which the circulating cooling gas is discharged.

6. The method according to claim 1 wherein said analysis is made at the low temperature inlet side of said coke quenching installation.

* * * * *